US006920887B2

(12) United States Patent
Lo

(10) Patent No.: US 6,920,887 B2
(45) Date of Patent: Jul. 26, 2005

(54) CONNECTOR FOR A RIB AND A SPREADER OF A PARASOL

(76) Inventor: Albert Chong-Jen Lo, 3023 Windy Knoll Ct., Rockville, MD (US) 20850

( * ) Notice: Subject to any disclaimer, the term of this patent is extended or adjusted under 35 U.S.C. 154(b) by 156 days.

(21) Appl. No.: 10/647,277

(22) Filed: Aug. 26, 2003

(65) Prior Publication Data

US 2005/0045218 A1 Mar. 3, 2005

(51) Int. Cl.[7] ..... A45B 25/00

(52) U.S. Cl. ..... 135/32; 135/29; 135/31; 403/117; 403/206

(58) Field of Search ..... 135/29, 31, 32, 135/909; 403/112–113, 117, 206, 233–235

(56) References Cited

U.S. PATENT DOCUMENTS

| | | | | | |
|---|---|---|---|---|---|
| 929,536 | A | * | 7/1909 | Babbit | 135/32 |
| 1,862,674 | A | * | 6/1932 | Frey | 135/32 |
| 5,551,463 | A | * | 9/1996 | Wang | 135/25.3 |
| 6,668,845 | B2 | * | 12/2003 | Lin et al. | 135/29 |
| 6,758,228 | B1 | * | 7/2004 | You | 135/29 |
| 2003/0010367 | A1 | * | 1/2003 | Ko | 135/32 |
| 2003/0041889 | A1 | * | 3/2003 | Lin et al. | 135/16 |

FOREIGN PATENT DOCUMENTS

| | | | | |
|---|---|---|---|---|
| FR | 2819698 | * | 7/2002 | A45B/25/02 |
| JP | 8-299040 | * | 11/1996 | A45B/25/02 |
| JP | 2002-125731 | * | 5/2002 | A45B/25/02 |
| JP | 2002-306219 | * | 10/2002 | A45B/25/02 |

* cited by examiner

*Primary Examiner*—Winnie Yip
(74) *Attorney, Agent, or Firm*—Bacon & Thomas PLLC

(57) ABSTRACT

A connector for a rib and a spreader of a parasol includes a metal connector body and an inner block made of plastic. The connector body has an upper clamp portion for each rib to fit therein, and two studs extending down from the connector body and defining an inner opening for the inner block to fit therein. The inner block has two side walls defining an inner opening as a turning passageway for each spreader to fit and connected pivotally, and a stop respectively in two sides of the passageway for stopping each spreader in case of collapsing the parasol. Then the side walls can prevent the connector body from contacting the shank to scrape the paint coated on the shank and prevent said shank from rusting. Further the stops can maintain the contained angle between each rib and each spreader not excessively small to permit the parasol easily expanded.

1 Claim, 8 Drawing Sheets

CONNECTOR FOR A RIB AND A SPREADER OF A PARASOL

BACKGROUND OF THE INVENTION

1. Field of the Invention

This invention relates to a connector for a rib and a spreader of a parasol, particularly to one possible to prevent a rib and a spreader from rubbing each other, and accordingly also to prevent the paint on the rib and the spreader from scrapped off by friction, and further capable to let the ribs and the spreaders all smoothly expand open from a collapsed condition.

2. Description of Prior Art

A conventional parasol shown in FIGS. 1 and 2 includes a shank 10, a plurality of ribs 20 and a plurality of spreaders 30. The ribs 20 respectively have their upper end connected pivotally with a ferrule 101 at the upper end of the shank 10, and the spreaders 30 respectively have their upper end pivotally connected with one end of a metal connector 40 and their lower end pivotally connected with an periphery of a ring 102 fitted around movably on the shank 10. The metal connector further has an inner hollow for an intermediate portion of each rib 20 to fit firmly therein. Then when the conventional parasol is in a collapsed condition, the ribs 20 and the spreaders 30 are all pulled to rest around the shank 10, with the ring 102 moved along the shank 10 from an upper position to a lower position and by means of the connectors 40 functioning pivots.

But as shown in FIGS. 1 and 2, in the conventional parasol, each rib 20 and each spreader 30 is connected by each connector 40, which is made of metal in order to strengthen their combining force. And each connector has an upper clamp portion 401 defining an inner opening for clamping each rib 20, and a pair of studs 402 separated defining an inner hollow envelops the upper end of each spreader 30 and then pivotally connects it with a rivet 50. In addition, an outer appearance of the conventional parasol is also important so the shank 10, the ribs 20 and the spreaders 30 are all painted colored.

As shown in FIG. 1, the ribs 20 and the spreaders 30 of the conventional parasol are respectively connected with the connectors 40, and all of them are made of metal, and the upper end of each spreader 30 is directly fitted in the studs 402 of each connector 40 for pivotally connection, with the inner surfaces of the studs 402 directly contacting with the outer surfaces of the upper end of each spreader 30. Then the conventional parasol is expanded open, with the studs 402 having their ends rotating with the rivet 50 as a pivot, causing the upper end of each spreader 30 rubs the studs 402 so the paint on the rubbed portion of the upper end of each spreader 30 may be scrapped off. Then repeated friction may gradually shave off the paint on a larger area to let metal material exposed. So the exposed area may become rusty, especially maybe worsened in rusting, by exposing the conventional parasol outdoors and receiving sunshine and rain often. Further, the shank 10 may gradually get rusted, too, after the ribs 20, the spreaders 30 and the connectors 40 got rusted, making the parasol unusable, shortening its service life, as all the ribs 20, the spreaders 30 and the connectors 40 rest around the shank 10 when the parasol is collapsed, with the studs 402 striking on the shank 10 and also scraping off the paint on the shank 10.

In addition, there is another problem arising from expanding the parasol from the collapsed condition. As shown in FIGS. 3 and 4, in case the parasol is to be expanded out from the collapsed condition, a user usually places the parasol in a horizontal position owing to the excessively long shank 10 and the excessive large dimensions of the canopy, and then the user moves the ring 102 upward along the shank 10 until the canopy expands a little, Then the user moves the parasol to an upright position to continue moving the ring 102 up until the canopy is fully expanded out. But it was found that when the parasol is laid in a horizontal position as shown in FIG. 3, those ribs 20, those spreaders 30, those connectors 40 and the canopy on the shank 10 rest downward on the shank 10 by the gravitational force so the contained angle $\alpha$ 1 between each rib 20 and each spreader 30 is very small as shown in FIG. 4, almost 0, or the point of each spreader 30 at each connector 40 sags a bit only. On the contrary, those ribs, those spreaders 30 and the canopy under the shank 10 sag down a little, having the contained angle $\alpha$ 2 between each rib becoming larger as shown in FIG. 4. Then a user may hardly move the ring 102 upward to expand the canopy out, and has to use a large force for pushing up the ring 102, which then moves the ribs 20 at first to expand a little for fully expanding the canopy fully out, very troublesome to handle.

SUMMARY OF THE INVENTION

This invention has been devised to offer a connector for a rib and a spreader of a parasol, which can prevent the ribs, the spreaders and the shank from rubbing one another and subsequently from scrapping paint coated on them and rusting.

Each connector consists of a connector body made of metal and an inner block made of plastic. The connect body has an upper clamp portion defining an inner opening for each rib to fit stably therein, and two studs extending down from the upper clamping portion and defining an inner opening for the inner block to fit therein. The inner block has two side walls defining an inner opening for an upper end of each spreader to fit therein and pivotally connected with the inner block and the connector body. The inner opening of the inner block functions as a turning passageway for each spreader. The inner block further has a stop respectively in two sides of the passageway to stop the upper end of each spreader in moving in case of collapsing the parasol. The two side walls protrudes out of the studs of the connector body to prevent the connector from contacting the shank in case of collapsing so the paint coated on the shank may not be scrapped off and subsequently not rust. Moreover, the stops in the inner block can maintain some contained angle between each rib and each spreader in case of collapsing the parasol to facilitate the parasol expanded out smoothly.

BRIEF DESCRIPTION OF DRAWINGS

The invention will be better understood by referring to the accompanying drawings, wherein.

DETAILED DESCRIPTION OF THE PREFERRED EMBODIMENT

Figure 1:
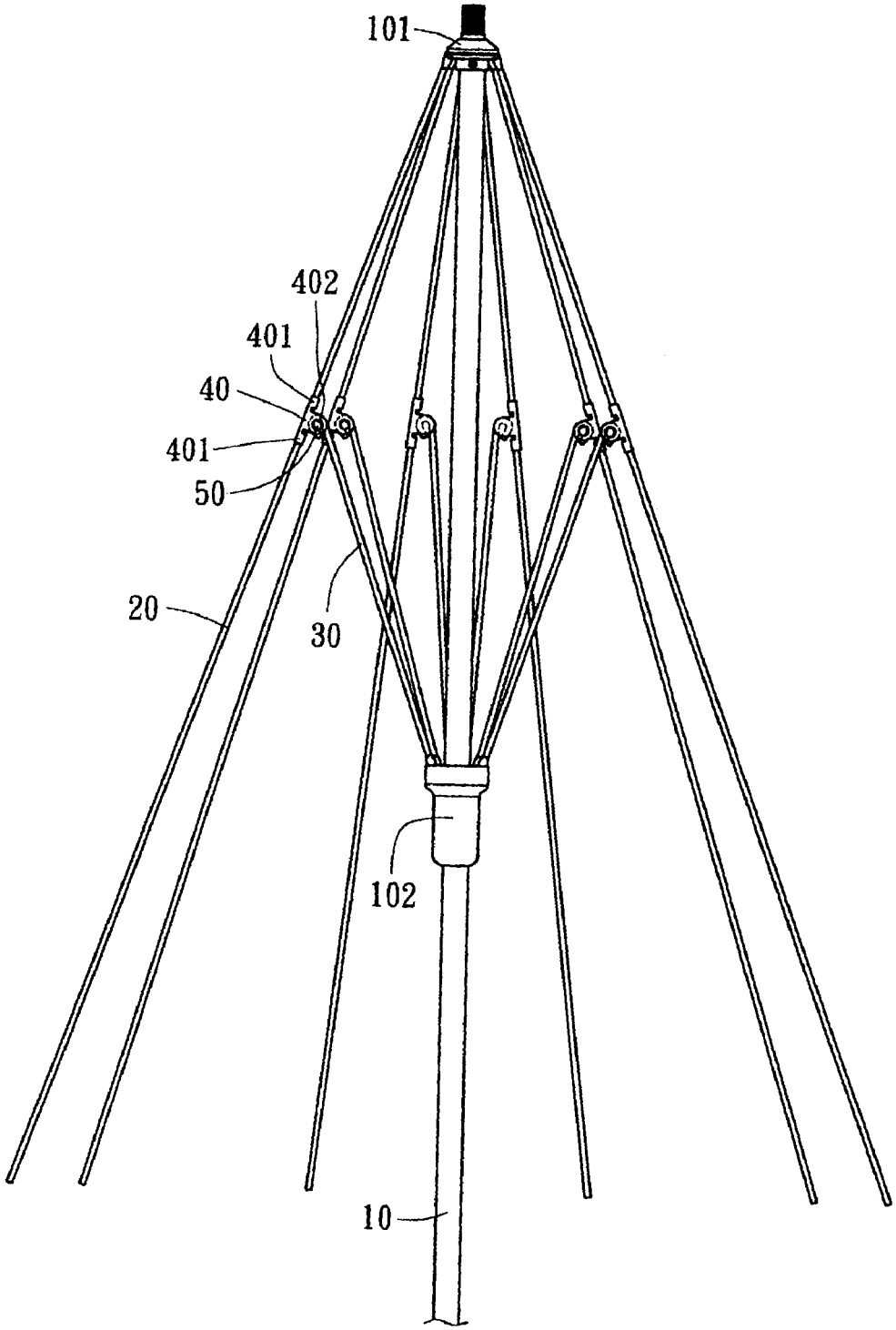
FIG. 1 (PRIOR ART)
FIG. 1 is a side view of a frame of a conventional parasol.
Figure 2:
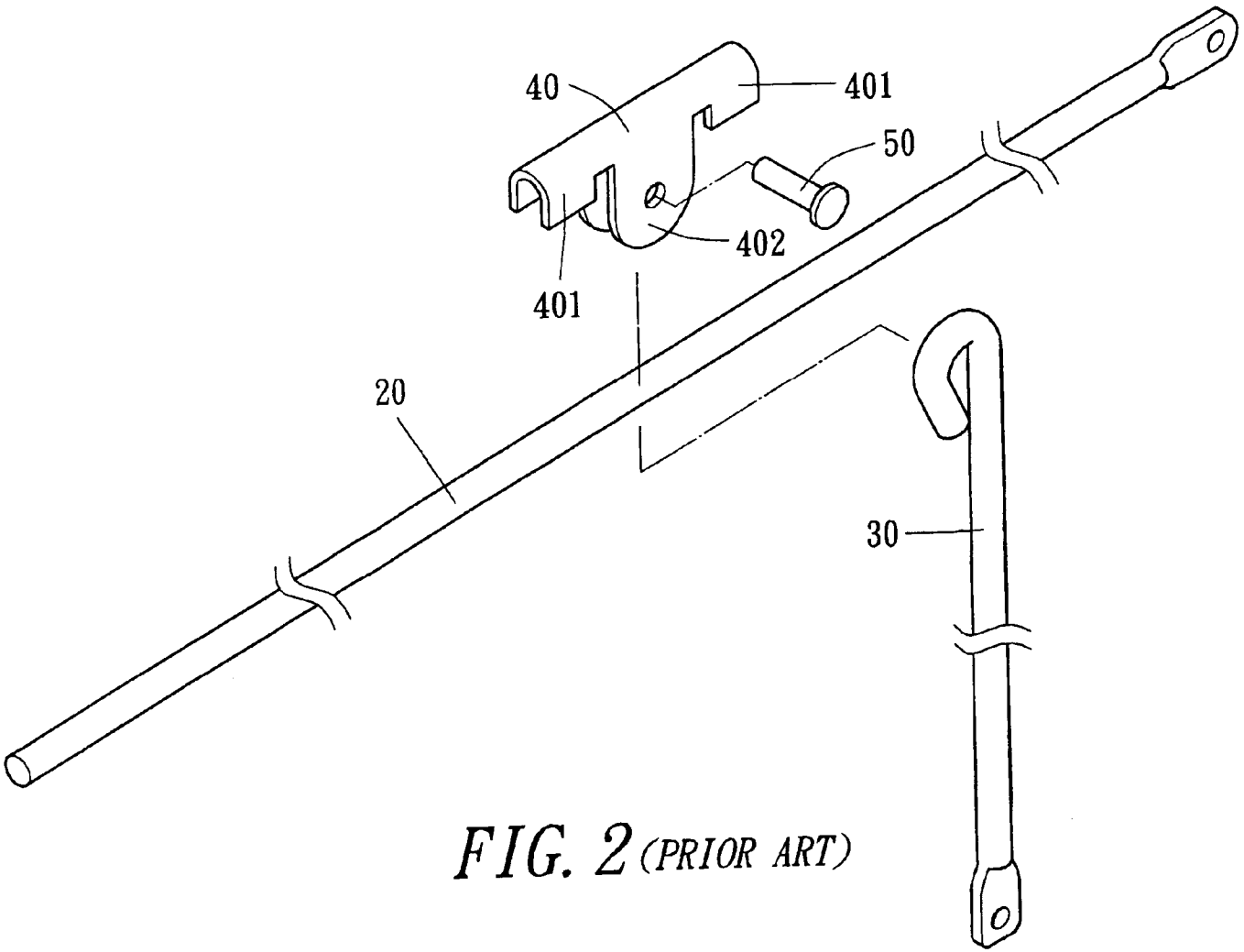
FIG. 2 (PRIOR ART)
FIG. 2 is an exploded perspective view of a rib, a spreader and a connector in the conventional parasol shown in FIG. 1.
Figure 3:
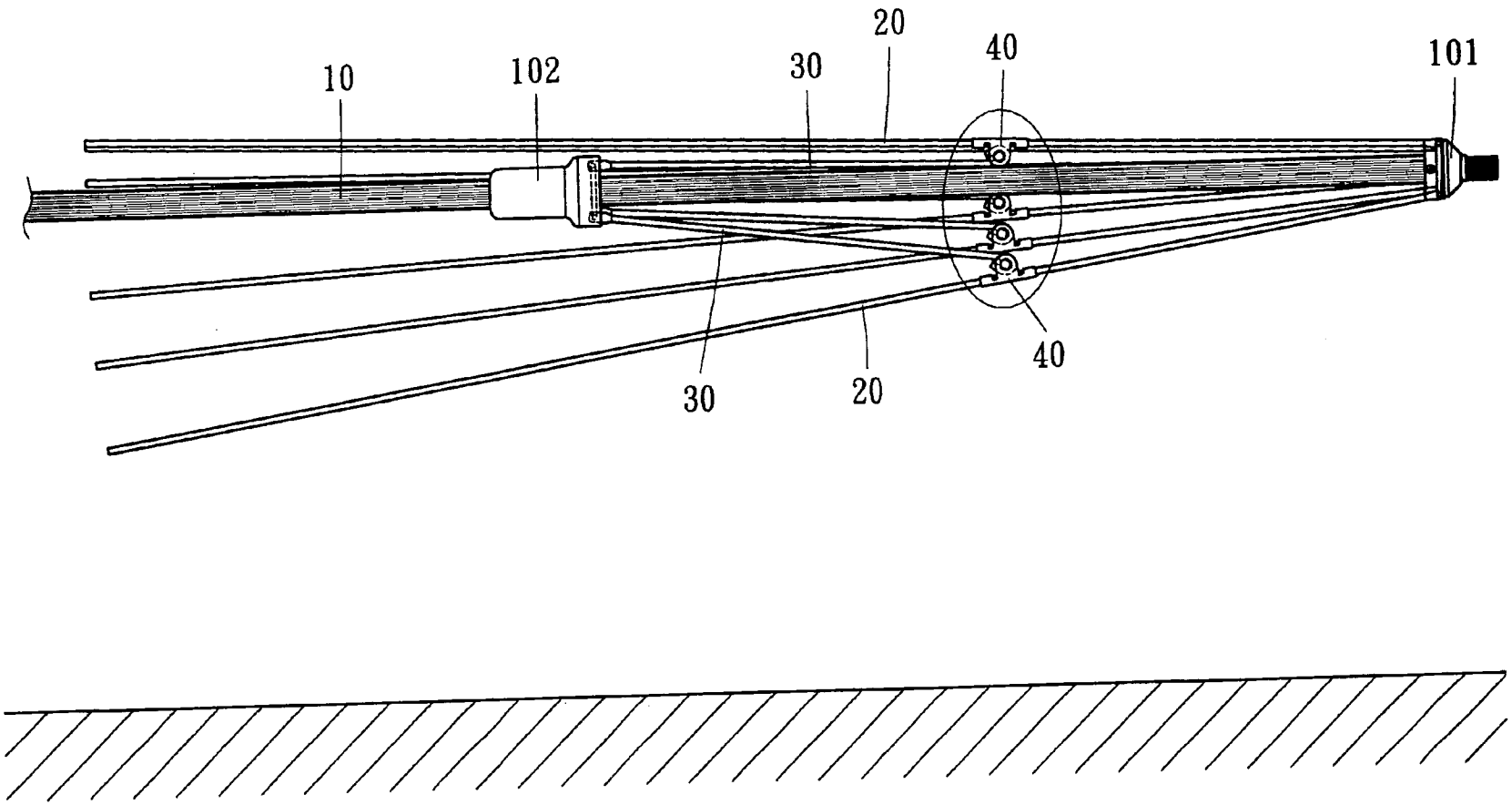
FIG. 3 (PRIOR ART)
FIG. 3 is a perspective view of the conventional parasol in a horizontal position.
Figure 4:
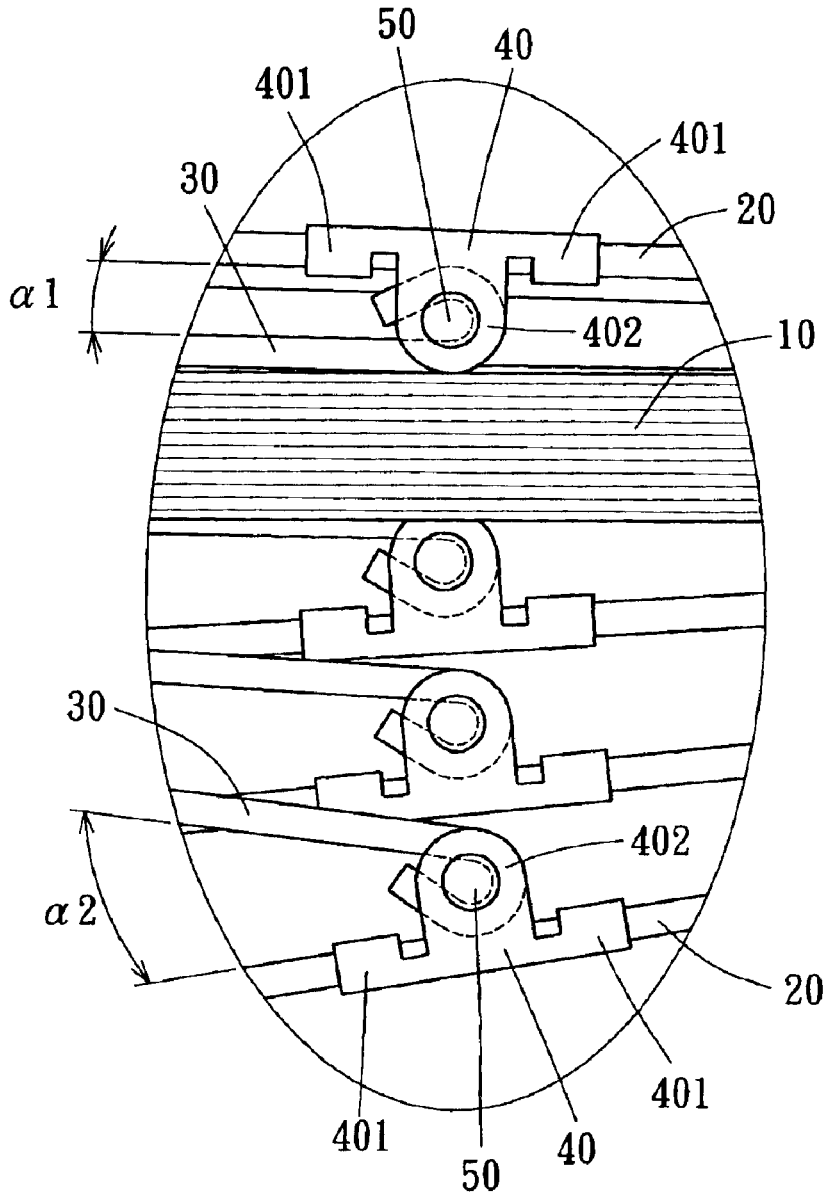
FIG. 4 (PRIOR ART)
FIG. 4 is a magnified view of the part circled in FIG. 3.
Figure 5:
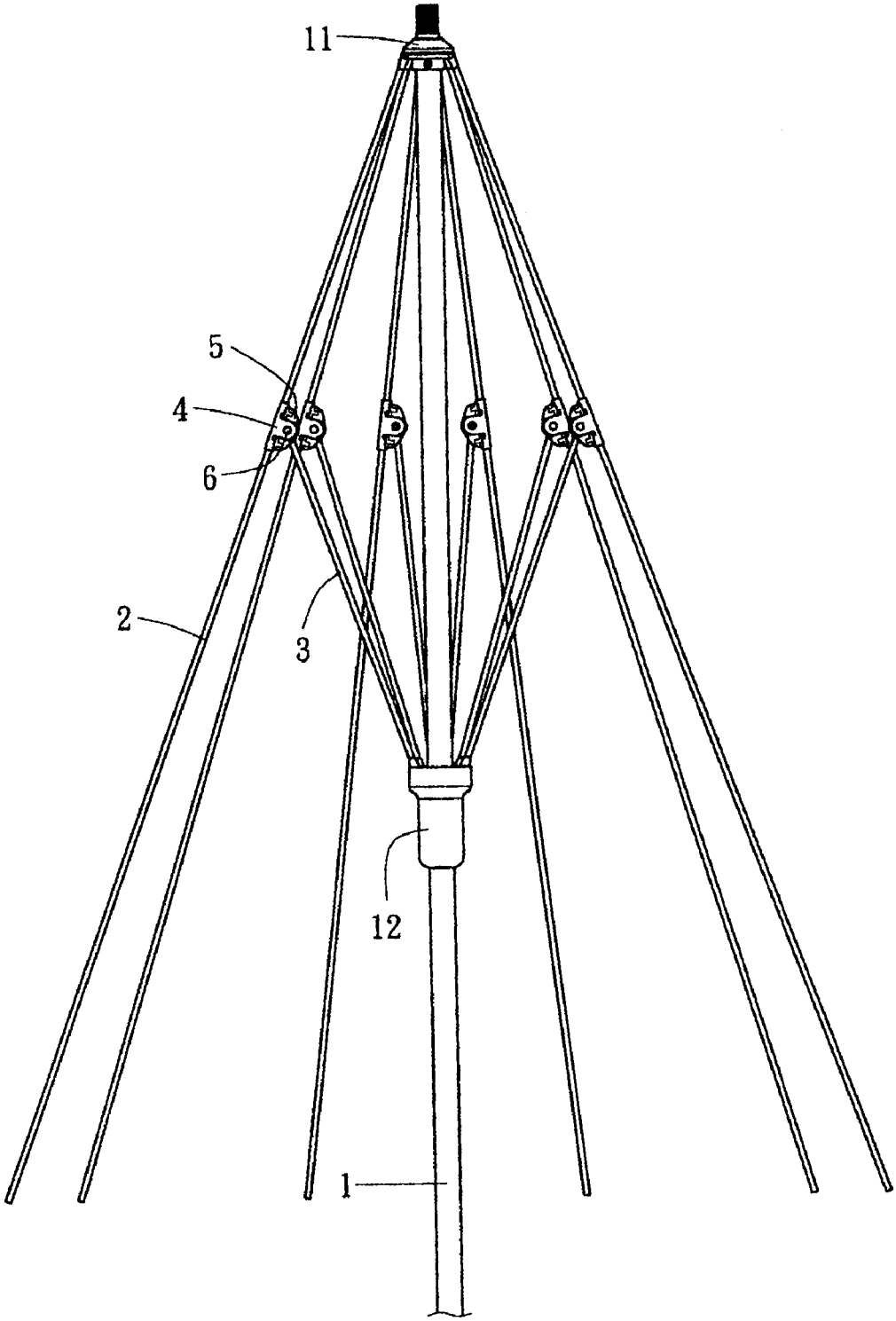
FIG. 5 is a side view of a frame of a parasol with a connector for a rib and a spreader of a parasol in the present invention.
Figure 6:
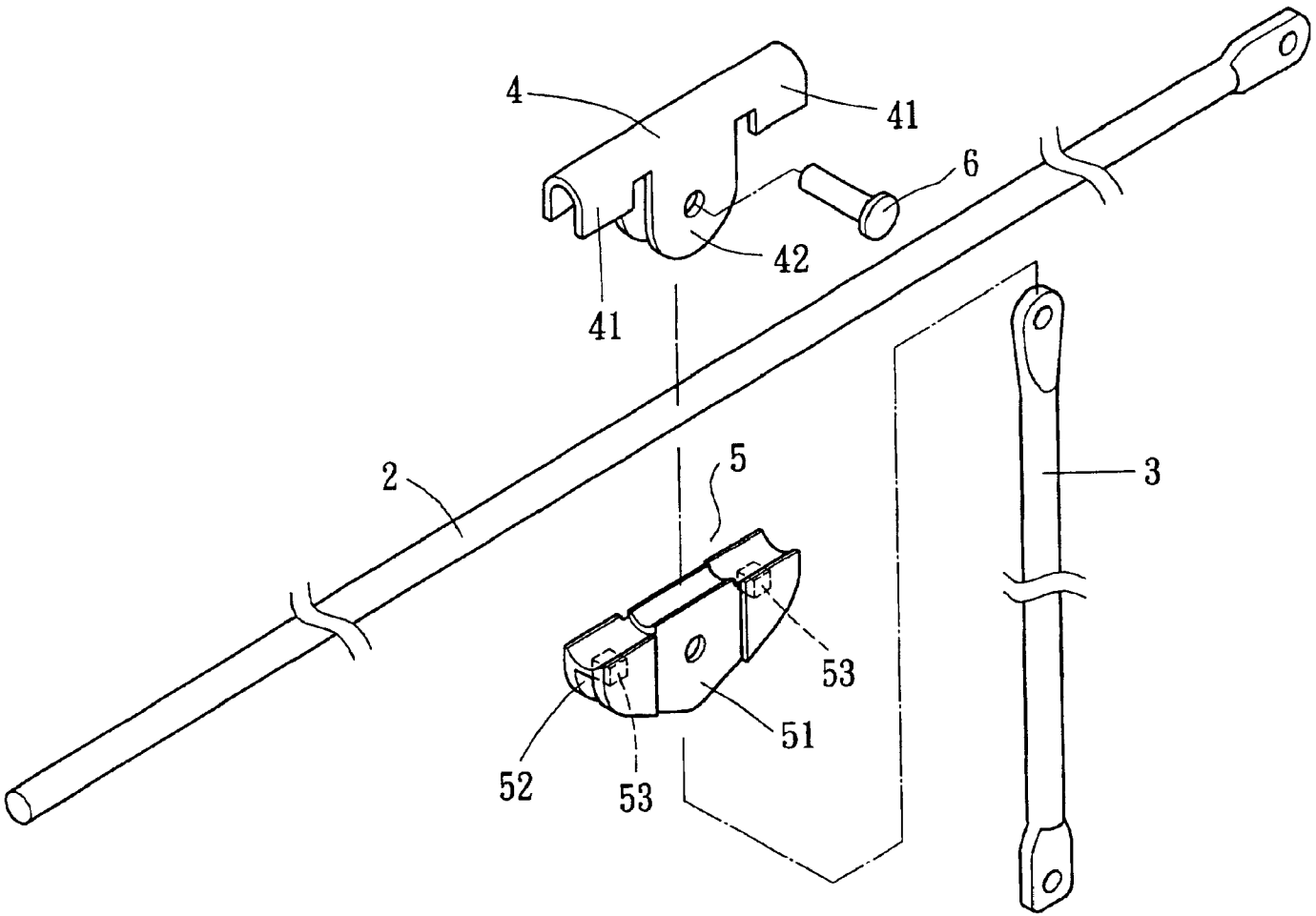
FIG. 6 is an exploded perspective view of a connector, a rib and a spreader in a parasol in the present invention.
Figure 7:
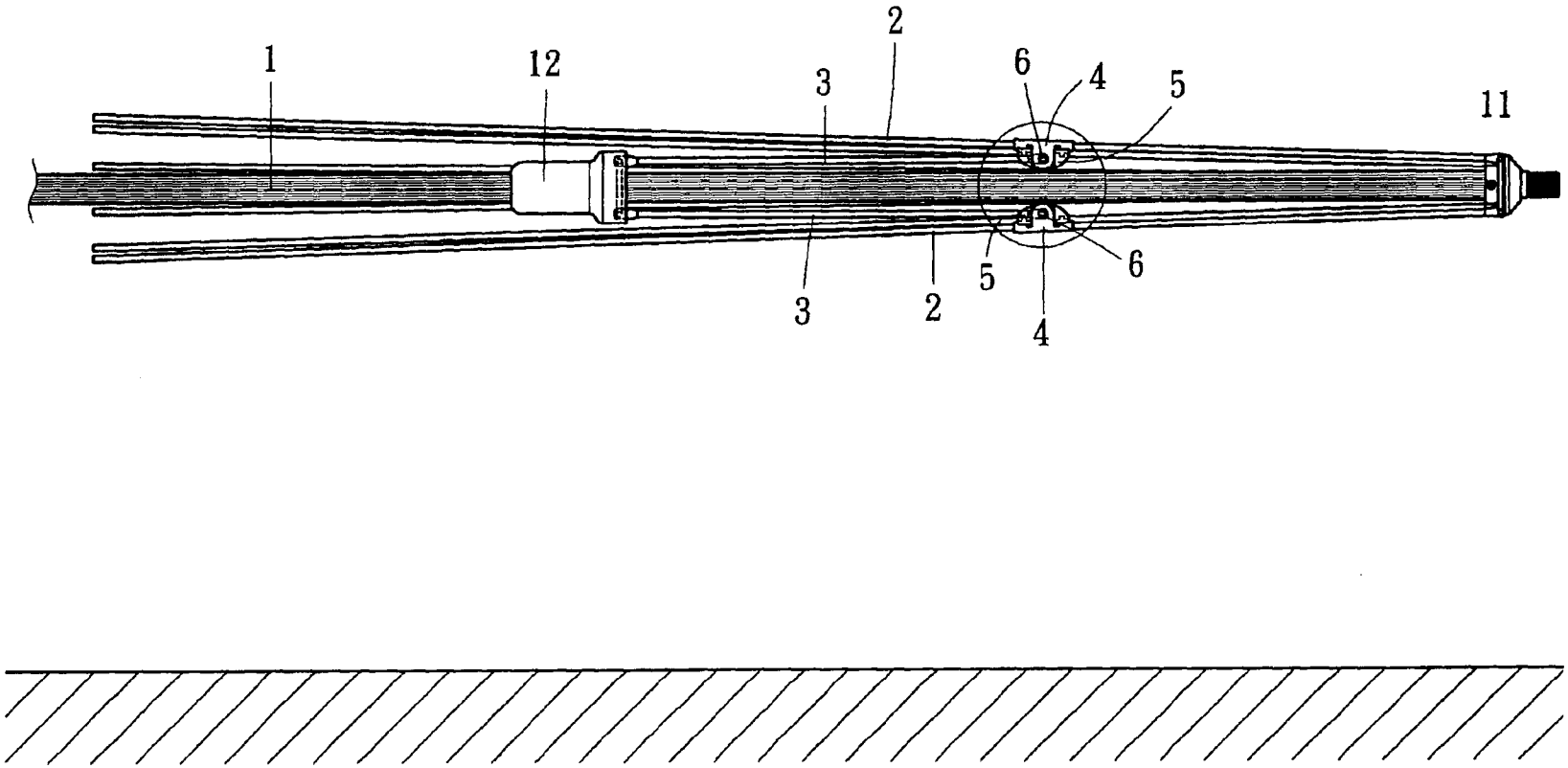
FIG. 7 is a side view of the parasol with the connector in the present invention laid horizontal position; and, FIG. 8 is a magnified view of the part circled in FIG. 6.

A preferred embodiment of a connector for a rib and a spreader of a parasol in the present invention, as shown in FIGS. 5 and 6, includes a connector body 4 and a U-shaped inner block 5 to be connected with a rib 20 and a spreader 30 of a parasol. The parasol has a shank 1, a plurality of ribs 2, a plurality of spreaders 3, a ring 12 as main components.

The shank 1 has its upper end fixed with a ferrule 11, and the ring 12 is fitted around the shank 1 to slide along the shank 1 for moving up and down the spreaders 3 for expanding and collapsing the parasol.

The ribs 2 have their upper ends pivotally connected with the periphery of the ferrule 11, and their intermediate portion fitted firmly in an upper clamp portion of the connector body 4.

Each connector body 4 has the upper clamp portion 41 defining an inner opening for each rib 2 to fit therein as shown in FIG. 6, and a pair of studs 42 extending down from the upper clamp portion 41 and defining an inner opening for pivotally connecting with each spreader 3.

The U-shaped inner block 5 is made of plastic or the like, to be fitted in the inner opening of the connector body 4, having two side walls 51 defining an inner turning passageway 52 for an upper end of each spreader 3 to fit therein and pivotally connected, The inner block 5 further has a stop 53 respectively provided in two sides of the passageway 52 for stopping movement of the spreader 3 in collapsing action. The number of the stop 53 may be one, but two is more convenient for combining with the connector body 4, without need of orienting the inner block with one stop 53, so speeding assemblage of the connector. Each spreader 3 has its upper round end inserted in the side walls 51 of the inner block 4 and connected pivotally with the connector by means of a rivet 6, and the lower end connected pivotally with the periphery of the ring 12.

In assembling, as shown in FIG. 6, firstly, the inner block 5 is inserted in the opening of the studs 42 of the connect body 4, and the upper round end of each spreader 3 is inserted in the turning passageway 53 of the side walls 51 of the inner block 5, and a rivet 6 is used to combine the spreader 3 and the connector body 4 and the inner block 5 together. Thus, two sidewalls of the inner block 5 are positioned between the upper end of each spreader 3 and the metal studs 42 of the connector body 4. Therefore, the upper end of each spreader 3 move within the plastic inner block 5 in case of expanding and collapsing the canopy of the parasol, without directly contact of the studs of the metal connect body 4 with the spreader 3, accordingly without friction of the spreader 3 against the studs to cause paint scrapping and subsequent rusting. Moreover, the side walls 51 of the inner block 5 protrude out of the studs 42, and the side walls 51 of plastic material contact the shank 1 in case of the parasol collapsed, preventing the metal studs 42 from collide against the shank 1, and subsequent friction, paint scrapping and rusting can be avoided.

Figure 8:
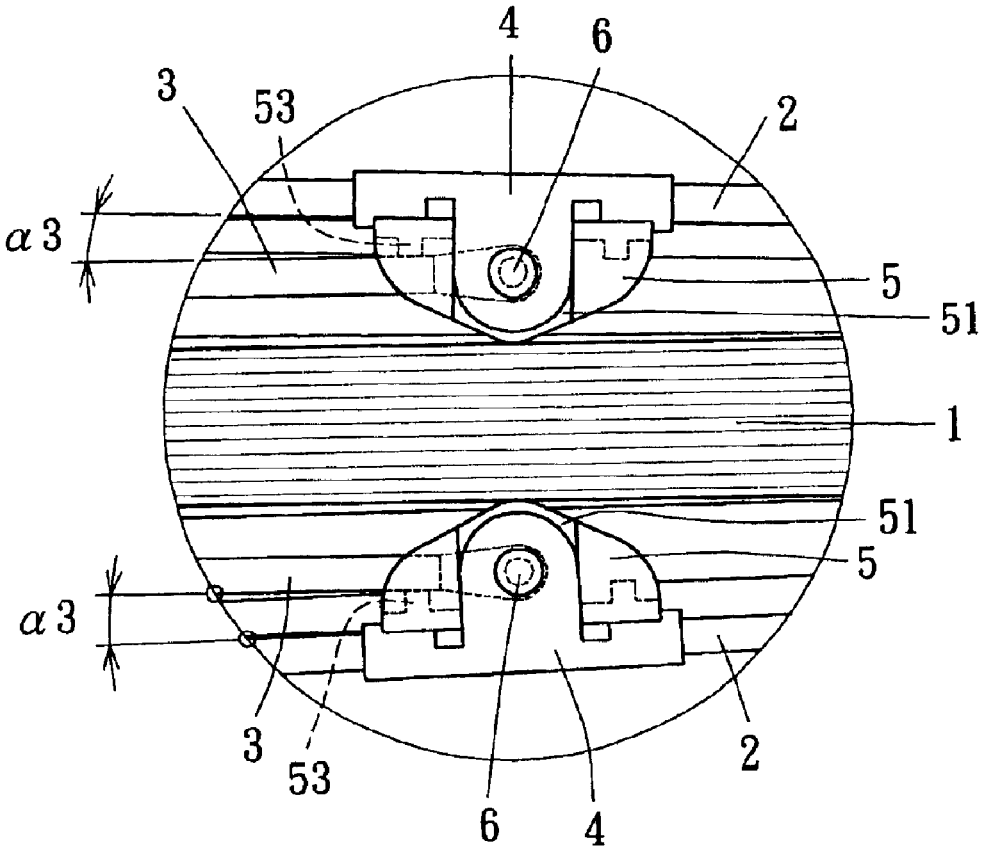

Another characteristic of the invention is easiness in expanding the parasol from the collapsed position, because the contained angle $\alpha$ 3 between each rib 2 and each spreader 3 on the shank 1 is not excessively small by means of the stop 53 as shown in FIG. 8, permitting the parasol expanded easily from the collapsed position.

While the preferred embodiment of the invention has been described above, it will be recognized and understood that various modifications may be made therein and the appended claims are intended to cover all such modifications that may fall within the spirit and scope of the invention.

What is claimed is:

1. A connector for a rib and a spreader of a parasol comprising a connector body and an inner block, said parasol having a shank and a plurality of ribs and a plurality of spreaders, said shank having its upper end fixed around with a ferrule, a ring fitted around said shank to move up and down along said shank, said ribs having their upper ends pivotally connected with said ferrule, each said rib having its intermediate portion fitted in each said connector body, each said spreader having its upper end pivotally connected with said connector body, said connect body having an upper clamp portion for clamping each said rib and two studs extending down from said upper clamp portion and defining an inner opening, each said spreader having its upper end pivotally connected with each said connector and its lower end pivotally connected with a periphery of said ring: and, characterized by the inner block made of plastic and fitted in said two studs of each connector body, said inner block having two side walls defining an inner opening, said two side walls protruding out of said studs of said connector body after said inner block is inserted in said connector body, said inner opening of said inner block functioning as a turning passageway, a stop respectively formed in two sides of said turning passageway; said side walls of said inner block located between said two studs and the upper end of each said spreader, said side walls preventing said studs of each said connector body from contacting said shank so as to keep paint coated on said shank integral and not rusting, said stops of each said inner block maintaining a contained angle between each said rib and said spreader in case of collapsing the parasol to facilitate the parasol collapsed.

* * * * *